United States Patent [19]

Chow

[11] Patent Number: 4,867,647

[45] Date of Patent: Sep. 19, 1989

[54] ELECTRIC FAN WITH A SPEED SELECTION DEVICE POSITIONED NEAR THE MOTOR

[76] Inventor: Kemneth Chow, No. 366, Lane 211, Chung-Yang Rd., Lung-Ching Hsiang, Taichung Hsien, Taiwan

[21] Appl. No.: 233,237

[22] Filed: Aug. 17, 1988

[51] Int. Cl.[4] ..... F04B 35/04

[52] U.S. Cl. ..... 417/423.7; 416/100; 416/170 R

[58] Field of Search ..... 417/423.7, 423.14, 423.15, 417/423.1; 415/125; 416/100, 246, 170 C, 247 R

[56] References Cited

U.S. PATENT DOCUMENTS

| | | | |
|---|---|---|---|
| 2,123,448 | 7/1938 | Weber | 417/423.15 X |
| 2,154,767 | 4/1939 | Newnham | 416/100 X |
| 2,618,434 | 11/1952 | Farnsworth | 416/100 |
| 2,634,905 | 4/1953 | Reisch | 416/100 X |
| 3,110,829 | 11/1963 | Sundt | 416/100 X |
| 3,625,633 | 12/1971 | Nelson | 416/100 X |

*Primary Examiner*—Leonard E. Smith

*Attorney, Agent, or Firm*—Kane, Dalsimer, Sullivan, Kurucz, Levy, Eisele & Richard

[57] ABSTRACT

An electric fan includes a speed selection device accommodated in a housing which is mounted rotatably on the upper end of a base support. The speed selection device is used to select the rotational speed of the fan blades. A push-pull actuator is mounted on the housing and can be actuated to rotate the housing relative to the support. The speed selection device includes a rotary knob which is mounted on the housing near the push-pull actuator.

2 Claims, 3 Drawing Sheets

ELECTRIC FAN WITH A SPEED SELECTION DEVICE POSITIONED NEAR THE MOTOR

BACKGROUND OF THE INVENTION

This invention relates to an electric fan, more particularly to one which has a speed selection device near the motor.

Because electric fans are smaller, more lightweight, less expensive, and easier to move in comparison to air conditioners, they enjoy a great popularity and are common in most households. Common electric fan typically includes a generally L-shaped support 1, and a motor 2 with a motor shaft for rotating a set of fan blades 3. Four speed selection push-buttons 4 are usually installed on the base of the support 1. The motor 2 is accommodated in housing 5. A push-pull actuator 2*a* is mounted movably on the housing 5. When the actuator 2*a* is depressed, the housing 5 can rotate relative to the support 1. When the actuator 2*a* is pulled upward, the housing 5 is fixed on the support 1. A plurality of electrical wires (not shown) interconnect the motor 2 and the push-buttons 4 and extend through the neck 1*a* of the support 1.

The conventional fan suffers from the following disadvantages:

(1) When the motor 2 is placed into the housing 5 and the electric wires are fastened to the push-buttons 4, said electric wires must be arranged in a predetermined order. The repeated arrangement of these electric wires is time-consuming.

(2) Because the motor 2 is remote from the pushbuttons 4, the electric wires are too long. These long electric wires largely increase the manufacturing costs of the fan in mass production.

(3) Because the push-buttons 4 are remote from the push-pull actuator 2*a*, it is also inconvenient to activate the push-buttons 4 and the push-pull actuator 2*a* simultaneously.

SUMMARY OF THE INVENTION

It is therefore the main object of this invention to provide an electric fan whose electric wires are easily and orderly arranged between the motor and the speed selection switch.

Another object of this invention is to provide an electric fan which has intimately spaced push-pull actuator and speed selection rotary knob for convenience in use, said push-pull actuator controlling the rotation of a motor accommodating housing relative to a base support.

According to this invention, an electric fan includes a motor, a housing for accommodating the motor therein, a set of fan blades mounted on the shaft of the motor, a support carrying the motor and the housing rotatably on the upper end thereof, means for selectively rotating the housing relative to the support, and a speed selection device electrically connected to the motor for selectively changing the rotational speed of the motor shaft. The speed selection device is installed in the housing and includes a rotary knob mounted rotatably on the housing and rotatable to adjust the rotational speed of the motor shaft. The rotating means includes a push-pull actuator mounted movably on the housing near the rotary knob. The actuator can be actuated so as to rotate the housing relative to the support. The housing is formed in its upper surface with a recess in which the rotary knob and the push-pull actuator are mounted.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENT

Figure 1:
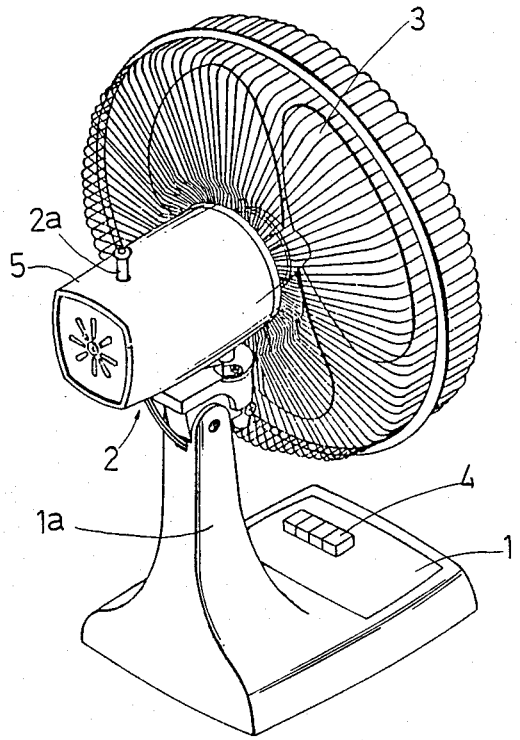
FIG. 1 PRIOR ART
FIG. 1 is a perspective view of a conventional electric fan.
Figure 2:
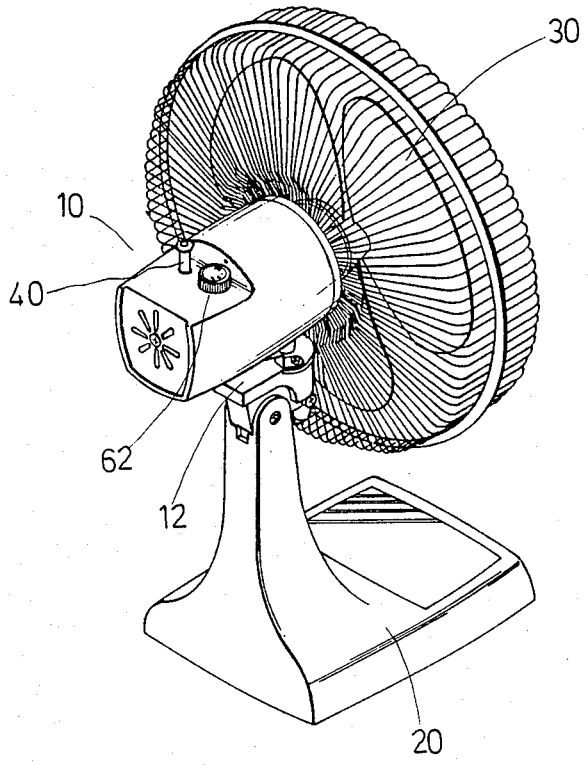
FIG. 2 is a perspective view of an electric fan according to this invention.
Figure 3:
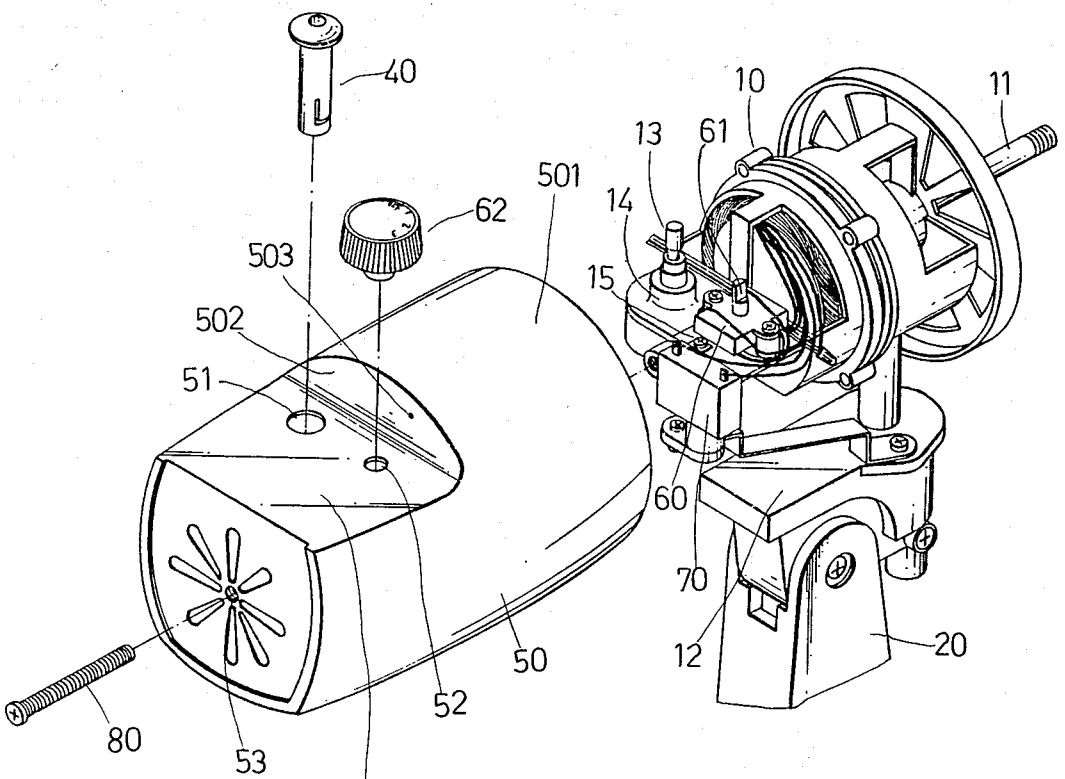
FIG. 3 is a partially exploded view showing the upper portion of the electric fan according to this invention.

Referring to FIGS. 2 and 3, an electric fan of this invention is shown. The electric fan includes a motor unit 10, a generally L-shaped base support 20 carrying the motor unit 10 rotatably on the upper end thereof, and a set of fan blades 30 mounted on the motor shaft 11 of the motor unit 10. the motor unit 10 is connected rotatbly on the support 20 by a motor supporting member 12.

A rotation selection rod 13 stands on a cylinder 14 which is secured to the back of the motor unit 10. A push-pull actuator 40 is sleeved on the upper end of the rotation selection rod 13 and extends through a large circular hole 51 of a barrel-like housing 50 in which the motor unit 10 is accommodated. A plate 15 is integrally formed with the cylinder 14. A speed selection body 60 is disposed on the upper surface of the plate 15. A capacitor 70 is secured to the side surface of the plate 15. A speed selection rod 61 stands on the speed selection body 60 and extends through a small circular hole 52.

A speed selection rotary knob 62 is secured to the upper end of the speed selection rod 61 near the push-pull actuator 40. An elongated bolt 80 is passed through an opening 53 of the back wall of the housing 50 into a threaded hole of the motor unit 10 so as to join the housing 50 and the motor unit 10 together. The upper surface 501 of the housing 50 has a recess 500 in which the push-pull actuator 40 and the rotary knob 62 are mounted so as to protect the pull acturator 40 and the rotary knob 62. An indicating point 503 is provided on the shoulder 502 of the housing 50 near the rotary knob 62 so as to indicate the selection of the rotational speed of the motor shaft 11.

It should be appreciated that it is easy to arrange, in order, electric wires between the motor unit 10 and the speed selection body 60 as well as between the motor unit 10 and the capacitor 70. Also, because the push-pull actuator 40 is near the rotary knob 62, it is convenient to activate both the actuator 40 and the rotary knob 62 simultaneously.

Furthermore, the length of electric wires according to this invention is shortened by about 30 mm in comparison with the length of those used in conventional electric fans. These shortened materials can largely reduce the manufacturing costs of electric fans in mass production.

Certainly, the cylinder 14 and the plate 15 may be formed separately and then secured to the motor unit 10.

With this invention thus explained, it is apparent that numerous modifications and variations can be made without departing from the scope and spirit of this invention. It is therefore intended that this invention be limited only as indicated in the appended claims.

I claim:

1. An electric fan comprising:

a motor including a motor shaft mounted rotatably thereon;

a housing for accommodating said motor therein;

a set of fan blades mounted on said motor shaft;

a support carrying both said motor and said housing rotatably on an upper end thereof;

means for selectively rotating said housing relative to said support, including a cylinder fixed in said housing, a rotation selection rod mounted vertically on an upper surface of said cylinder, and a push-pull actuator mounted movably on said housing and connected operatively to an upper end of said rotation selection rod, said push-pull actuator being actuatable to rotate said housing relative to said support;

a speed selection device including a plate integral with said cylinder in said housing, a speed selection body disposed on an upper surface of said plate and electrically connected to said motor, a speed selection rod mounted vertically on an upper surface of said speed selection body, a capacitor secured to a side surface of said plate and electrically connected to said motor, and a rotary knob mounted rotatably on said housing near said push-pull actuator and connected operatively to an upper end of said speed selection rod, said rotary knob being rotatable to adjust rotational speed of said motor shaft.

2. An electric fan as claimed in claim 1, wherein said housing is formed in its upper surface with a recess in which said rotary knob and said push-pull actuator are mounted.

* * * * *